US005921518A

United States Patent [19]

Bernardi

[11] Patent Number: 5,921,518

[45] Date of Patent: Jul. 13, 1999

[54] FLEXIBLE PICTURE HANGER

[76] Inventor: Eugene L. Bernardi, #501-1555 Eastern Avenue, North Vancouver, British Columbia, Canada, V7L 3G2

[21] Appl. No.: 08/918,337

[22] Filed: Aug. 26, 1997

Related U.S. Application Data

[60] Provisional application No. 60/026,545, Sep. 23, 1996.

[51] Int. Cl.[6] ..... F16B 45/00

[52] U.S. Cl. ..... 248/304; 40/757; 248/494

[58] Field of Search ..... 248/304, 475.1, 248/489, 493, 494, 549; 411/458, 459, 460; 40/746, 757, 759

[56] References Cited

U.S. PATENT DOCUMENTS

| | | | |
|---|---|---|---|
| 417,805 | 12/1889 | Beaman | 248/494 |
| 515,952 | 3/1894 | Curtis | 411/458 |
| 1,177,106 | 3/1916 | Hickerson et al. | 248/494 |
| 1,455,961 | 5/1923 | Maier | 248/493 |
| 1,675,282 | 6/1928 | Strand | 411/458 |
| 2,384,478 | 9/1945 | Lapyre | 248/493 |
| 2,793,566 | 5/1957 | Burtchaell | 248/489 |
| 3,399,429 | 9/1968 | Goodman | 248/467 |
| 4,509,713 | 4/1985 | Hogg | 248/546 |
| 4,606,526 | 8/1986 | Rabinowitz | 248/489 |
| 4,610,419 | 9/1986 | Swanson | 248/547 |
| 4,619,430 | 10/1986 | Hogg | 248/467 |
| 4,863,135 | 9/1989 | Mellor et al. | 248/493 |
| 5,018,697 | 5/1991 | Treanor et al. | 248/547 |
| 5,069,412 | 12/1991 | Jacob | 248/493 |
| 5,178,355 | 1/1993 | Herzig | 248/489 |
| 5,267,719 | 12/1993 | Keller | 248/493 |
| 5,364,057 | 11/1994 | Pynenburg | 248/475.1 |
| 5,384,198 | 1/1995 | Hodges | 248/466 |
| 5,437,429 | 8/1995 | Atlas | 248/493 |
| 5,507,545 | 4/1996 | Krysiak | 248/304 |

*Primary Examiner*—Ramon O. Ramirez
*Assistant Examiner*—Robert Lipcsik
*Attorney, Agent, or Firm*—Oyen, Wiggs, Green & Mutala

[57] ABSTRACT

A picture hanger in the form of a flexible member having upper and lower edges positionable against a wall. A picture wire-receiving groove extends along the upper edge. An aperture extends through the member, between the edges. A fastener such as a nail or screw is inserted through the aperture, into the wall, to compressibly bias the flexible member against the wall. The flexible member is formed such that it curves outwardly, away from the wall, before it is fastened to the wall. A ridge which protrudes into and extends longitudinally along the groove grips the wire firmly and retains it within the groove. The aperture is located within a recess formed in the flexible member. The base of the recess contacts the wall when the member is fastened to the wall. The recess may be in the form of a trough extending across the member, parallel to the edges. A support surface is provided within the recess, around the aperture. The support surface is inclined inwardly at about 45° with respect to the wall when the member is biased against the wall. The support surface facilitates alignment and seating of a nail driven through the aperture into the wall. The wire used to hang the picture may be rigid. In such case the wire (which is connected to the picture in a way which allows the wire to rotate at such connections) can be pre-gripped within the hanger's picture wire-receiving groove. The wire and hanger can then be rotated away from the picture, toward the wall on which the picture is to be hung. This facilitates accurate location of the point at which the hanger should be fastened to the wall while leaving a workspace between the picture and the wall.

10 Claims, 5 Drawing Sheets

FIG. 5A
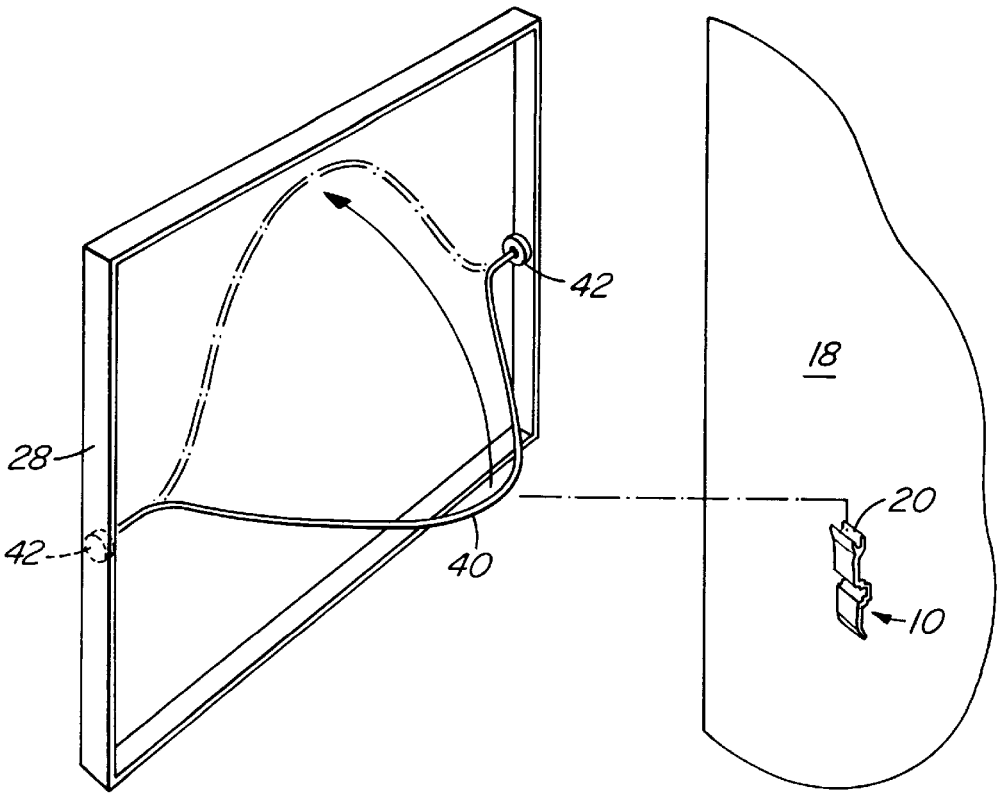
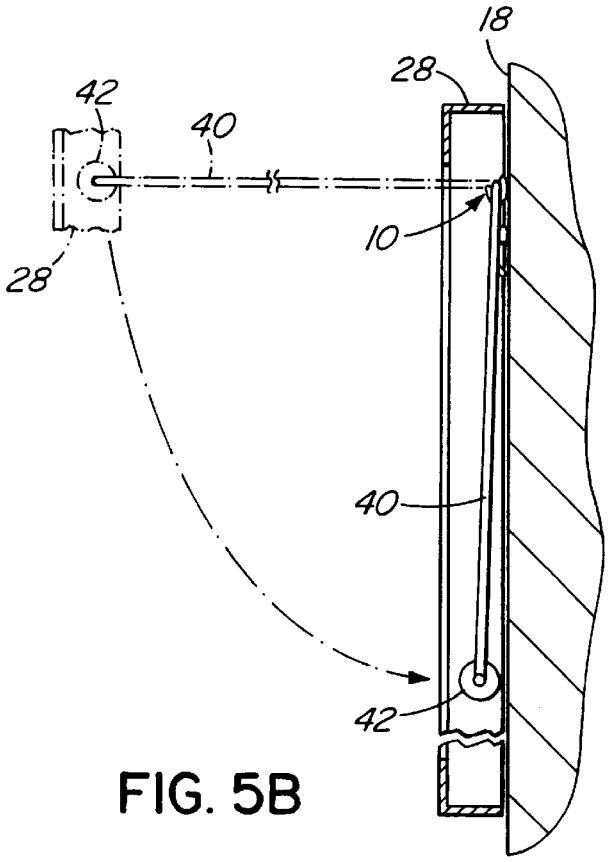
FIG. 5B

FLEXIBLE PICTURE HANGER

REFERENCE TO RELATED APPLICATION

This application claims the benefit of United States Provisional Application No. 60/026,545 filed Sep. 23, 1996.

TECHNICAL FIELD

This application pertains to a flexible picture hanger having a groove which grips the wire used to hang the picture. The act of fastening the picture hanger to a wall compressibly biases the picture hanger against said wall. A picture hung from a wire gripped within the groove is less prone to tilting than pictures hung by other means.

BACKGROUND

Pictures hung on walls by conventional means often tilt away from their preferred horizontal orientation, due to normal vibrations which are transmitted through the wall. For example, the impact of a door closing within a door frame may cause sufficient vibration to tilt pictures hung in rooms proximate to the door.

Pictures are commonly hung by suspending picture wire fastened to the back of the picture over a nail driven into the wall, or over two such horizontally spaced nails, or over a BullDog™ type picture hanger fastened to the wall, or over two such horizontally spaced picture hangers. Because the picture wire makes only point contact with the nail(s) or hanger(s), the aforementioned vibrations tend to make the wire slip sideways over the nail(s) or hanger(s). Although such slippage is reduced somewhat if the nail(s) or hanger(s) are used in pairs, there is still some potential for slippage. The problem is exacerbated by the fact that commonly available picture hangers are not normally securely fastened to the wall, but are fastened in a way which allows the picture hanger to pivot on the fastening member (which is usually a nail driven through the picture hanger into the wall).

The present invention addresses and overcomes the foregoing problems.

SUMMARY OF INVENTION

The invention provides a picture hanger in the form of a flexible member having upper and lower edges which are positionable against a wall. A picture wire-receiving groove extends along the upper edge, and an aperture extends through the member between the edges. A fastener such as a nail or screw is inserted through the aperture, into the wall, to compressibly bias the flexible member against the wall. Advantageously, the flexible member is formed such that it curves outwardly, away from the wall, before it is fastened to the wall.

Preferably, the picture wire-receiving groove incorporates a wire gripping means for gripping the picture wire. The wire gripping means may take the form of a ridge which protrudes into and extends longitudinally along the groove.

A recess may be formed in the flexible member, with the aforementioned aperture being located in the recess. The base of the recess contacts the wall when the member is fastened to the wall. The recess may be in the form of a trough extending across the member, parallel to the edges. A support surface is provided within the recess, around the aperture. The support surface is inclined inwardly at about 45° with respect to the wall when the member is biased against the wall. The support surface facilitates alignment and seating of a nail driven through the aperture into the wall.

Optionally, the wire used to hang the picture may be rigid. In such case the wire (which is connected to the picture in a way which allows the wire to rotate at such connections) can be pre-gripped within the hanger's picture wire-receiving groove. The wire and hanger are then rotated away from the picture, toward the wall on which the picture is to be hung. This facilitates accurate location of the point at which the hanger is fastened to the wall, while leaving a workspace between the picture and the wall.

BRIEF DESCRIPTION OF DRAWINGS

FIG. 5A is a pictorial illustration showing the invention fastened to a wall and supporting a picture via rigid wire. FIG. 5B shows the same apparatus as FIG. 5A and illustrates how the rigid wire allows the picture to be moved rotatably with respect to the wall.

DESCRIPTION

Figure 1:
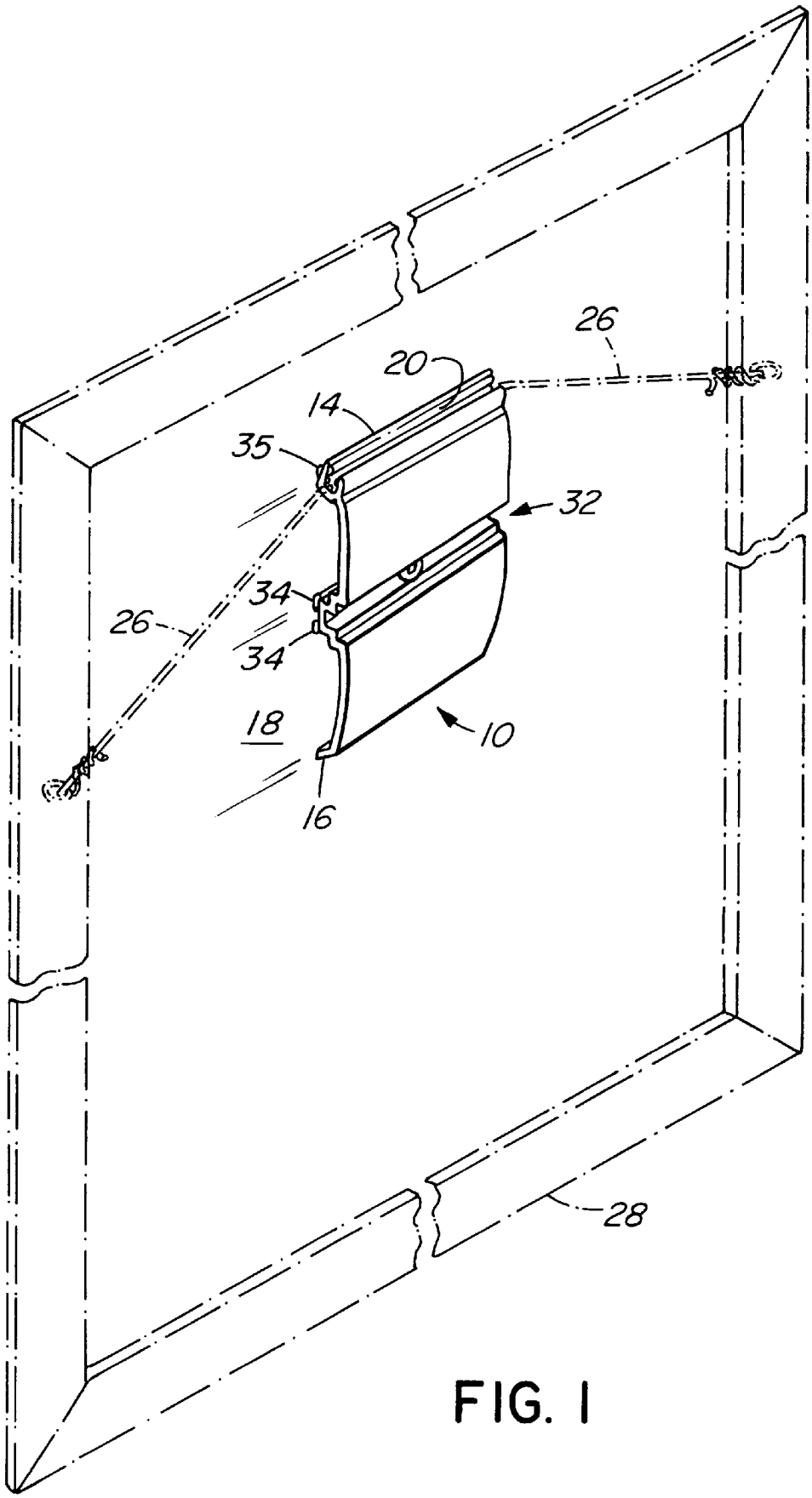
FIG. 1 is a pictorial illustration showing a screw fastener embodiment of the invention fastened to a wall and supporting a picture.
Figure 2:
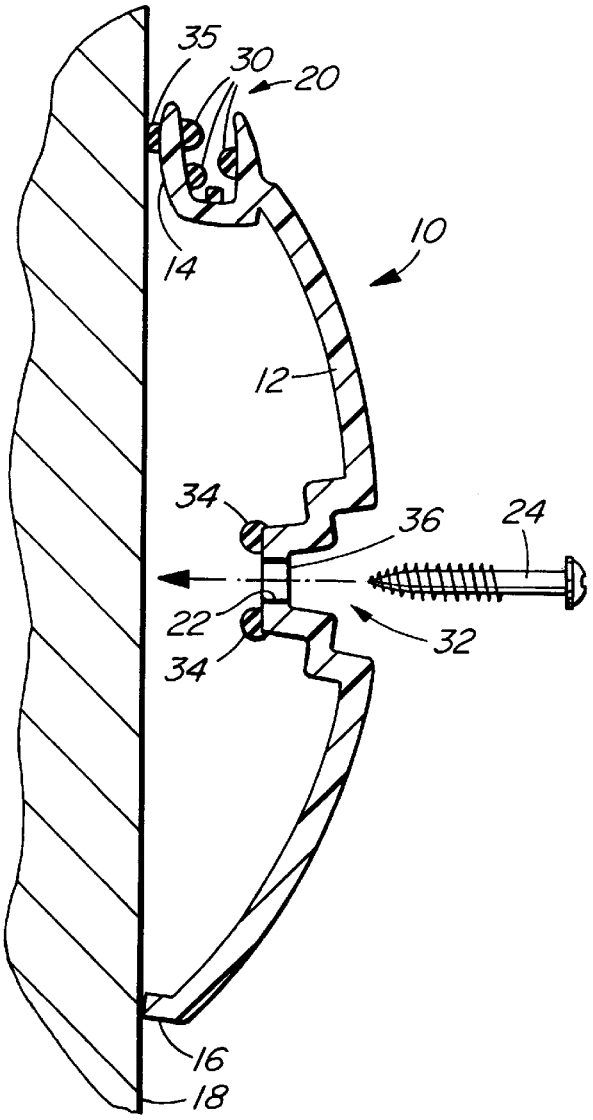
FIG. 2 is an enlarged, side elevation cross-sectional view of the screw fastener embodiment of the invention, shown prior to insertion of the screw.
Figure 3:
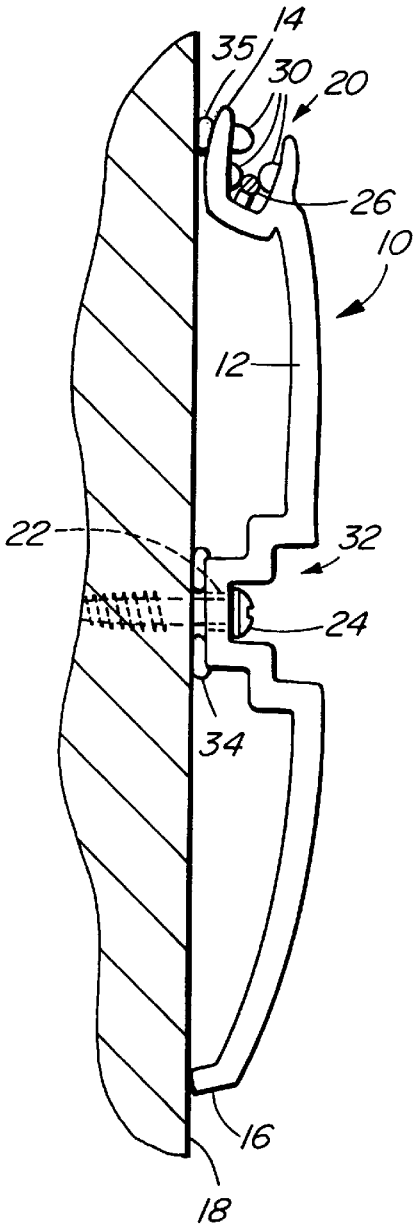
FIG. 3 is an enlarged side elevation view of the screw fastener embodiment of the invention, shown after insertion of the screw.

FIGS. 1, 2 and 3 depict a picture hanger generally designated 10 in the form of a flexible member 12 having generally parallel upper and lower edges 14, 16 which are positionable against wall 18. A groove 20 is formed along upper edge 14, to receive and grip a wire as hereinafter explained. An aperture 22 extends through member 12, between edges 14, 16. As best seen in FIG. 2, member 12 is formed such that, before member 12 is fastened to wall 18, member 12 curves outwardly away from wall 18, such that a notional plane (not shown ) extends between upper and lower edges 14, 16 parallel to wall 18 when hanger 10 is positioned adjacent wall 18 as shown in FIG. 2. As best seen in FIG. 3, when member 12 is fastened to wall 18 (by inserting a fastener such as screw 24 through aperture 22 into wall 18) base portion 34 of member 12. Is compressibly deformed and biased against wall 18 (i.e. base 34 is biased from a position away from the aforementioned notional plane into a position within the notional plane), thereby retaining member 12 firmly in place on wall 18 and resisting rotational movement of member 12 with respect to screw 24.

As previously mentioned, groove 20 receives and grips picture wire 26 (FIGS. 1 and 3), which is fastened to picture 28 (shown only in FIG. 1, in dashed outline) in well known fashion. The gripping function is achieved by providing one or more flexible ridges 30, which protrude into and extend longitudinally along groove 20. Flexible ridges 30 contact wire 26 and resist longitudinal motion thereof with respect to groove 20.

A recess 32 may be formed in member 12, around aperture 22. The base 34 of recess 32 contacts wall 18 when picture hanger 10 is fastened to wall 18. If desired, base 34 may be augmented, as seen in FIGS. 1, 2 and 3, by providing one or more flexible ridges thereon which compress (FIG. 3) when picture hanger 10 is fastened to wall 18, thereby further resisting rotational movement of member 12 with respect to screw 24. Either or both of edges 14, 16 may be similarly augmented for the same purpose (i.e by adding flexible ridge 35). As best seen in FIG. 1, recess 32 may be in the form of a trough extending across member 12, parallel to edges 14, 16. A support surface 36 (FIG. 2) within recess 32 surrounds aperture 22. The head of screw 24 bears against support surface 36 when screw 24 is fully inserted, as seen in FIG. 3.

Picture hanger 10, including any of the aforementioned ridge augmentations is preferably formed as a single plastic extrusion, with the ridge augmentations being formed of softer, more flexible material than the remainder of picture hanger 10. The softer, more flexible material is better able to grip those portions of the picture hanging wire or the wall which such portions contact, thus improving resistance to rotational movement.

Figure 4A:
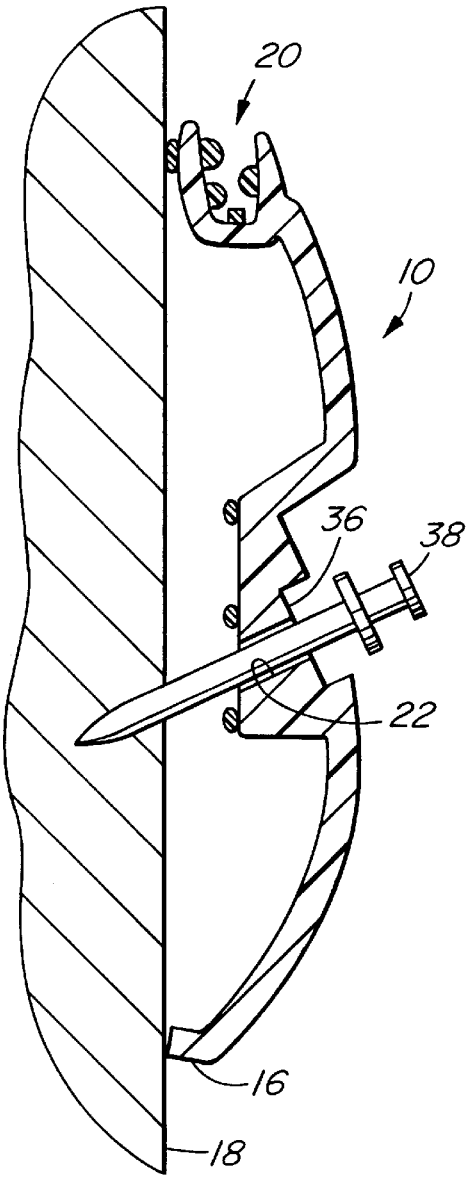
FIG. 4A is an enlarged side elevation view of the nail fastener embodiment of the invention, shown during insertion of the nail.
Figure 4B:
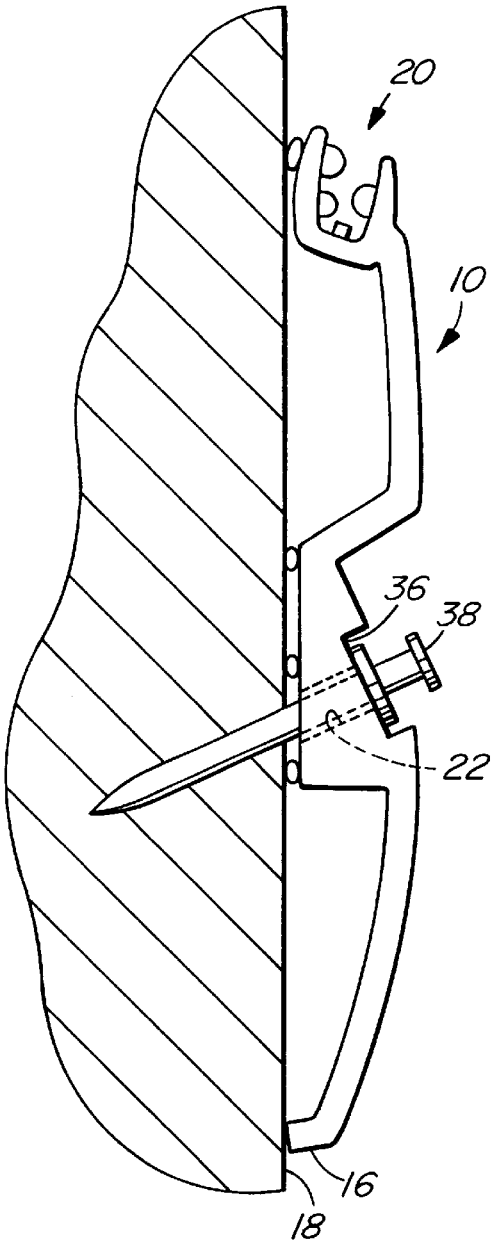
FIG. 4B is an enlarged side elevation view of the nail fastener embodiment of the invention, shown after full insertion of the nail.

The embodiment of the invention illustrated in FIGS. 4A and 4B is substantially identical to the screw fastener embodiment of FIGS. 1, 2 and 3 except that the embodiment of FIGS. 4A and 4B is adapted to use with a nail fastener. More particularly, in the embodiment of FIGS. 4A and 4B, support surface 36 is inclined inwardly at about 45° with respect to wall 18 when picture hanger 10 is fastened to wall 18. An angle of about 45° is the preferred angle at which a nail 38 is driven through aperture 22 to fasten picture hanger 10 to wall 18. The embodiment of FIGS. 4A and 4B thus facilitates initial alignment of nail 38 and also serves to seat the nail's head. It is particularly convenient to employ a double-headed nail, as seen in FIGS. 4A, 4B in order to avoid having to use a punch to seat the nail's head firmly against support surface 36 as seen in FIG. 4B.

As shown in FIGS. 5A and 5B, the wire used to hang picture 28 may be rigid, instead of being conventional flexible picture hanging wire. If such a rigid wire 40 is used the wire can be formed into a semi-circular loop and pre-connected to the picture frame via suitable joints 42 which allow the ends of wire 40 to rotate freely with respect to the frame. Picture hanger 10 can then be clipped onto the central portion of wire 40 by pressing wire 40 into groove 20 to grip wire 40 as aforesaid. This allows wire 40 and hanger 10 to pivot through an arc with respect to the rear surface of picture 28. The arc (represented by the arrows shown in FIGS. 5A and 5B) defines a workspace between wall 18 and picture 28 within which one may more comfortably reach to position picture hanger 10 at a preferred location on wall 18, in comparison to the more cramped quarters within which one must work if conventional flexible picture hanging wire is used. Rigid wire 40 also facilitates accurate location of the point at which picture hanger 10 should be fastened to wall 18 in order to position picture 28 at the desired elevation when picture 28 is allowed to rotate into its final position against wall 18.

Figure 6:
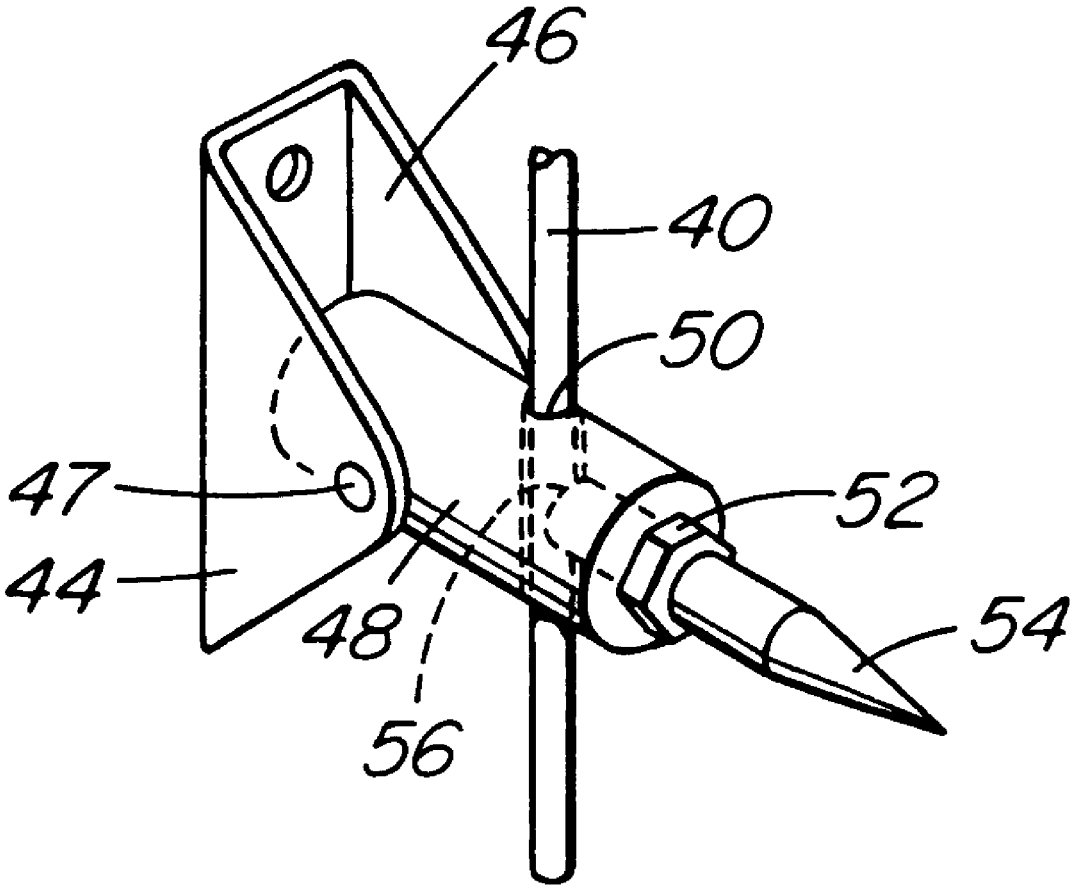
FIG. 6 is an enlarged pictorial illustration of a joint for coupling one end of a length of picture hanging wire to a picture frame.

FIG. 6 depicts one possible version of a joint which can be fastened to one side of a picture frame and used to couple a length of picture hanging wire to the frame. Opposed flanges 46 are pivotally connected at 47 to member 48, thus allowing member 48 to pivot upwardly or downwardly between flanges 46. One end of a length of picture hanging wire 40 (or conventional flexible wire 26) is passed through aperture 50 in member 48. Nut 52 is then rotated to threadably advance the internal butt end 56 of rod 54 toward and into contact with the wire. Nut 52 is then tightened to securely crimp fasten the wire within member 48. An identical joint is attached to the opposite side of the picture frame and crimp fastened to the opposite end of the wire. When the picture is hung, the pointed ends of each rod 54 project rear-wardly, toward the wall. Once the picture is levelled, one need only grip the frame near the opposed joints and press it against the wall in order to force the pointed ends of each rod 54 into the wall. In combination with the picture hanger used to hang the picture, the pointed ends of each rod 54 form a three point fastening system which securely attaches the picture to the wall and resists rotational slippage thereof.

As will be apparent to those skilled in the art in the light of the foregoing disclosure, many alterations and modifications are possible in the practice of this invention without departing from the spirit or scope thereof. For example, hanger 10 may be used to hang plaques, framed documents, maps or other objects supported by a wire fastened to the back of the object. As another example, if joints like those shown FIG. 6 are used, a simple nail or screw can be substituted for picture hanger 10 without compromising the aforementioned three point fastening system. Accordingly, the scope of the invention is to be construed in accordance with the substance defined by the following claims.

What is claimed is:

1. A picture hanger, comprising:

(a) a flexible member having upper and lower edges positionable against a wall, said upper and lower edges defining a plane;

(b) a groove extending along said upper edge for receiving a picture wire within said groove;

(c) an aperture extending through said member between said edges;

(d) a base portion between said upper and lower edges, said base portion displaced from said plane; and, (e) a fastener insertable through said aperture and into said wall;

whereby, when said fastener is driven into a wall, said fastener compressibly deforms said member and biases said base portion from its position displaced from said plane into a position within said plane.

2. A picture hanger as defined in claim 1, wherein said member curves outwardly between said upper and lower edges, prior to said biasing.

3. A picture hanger as defined in claim 1, said groove further comprising wire gripping means for gripping said picture wire.

4. A picture hanger as defined in claim 3, wherein said wire gripping means further comprises at least one flexible ridge protruding into and extending longitudinally along said groove.

5. A picture hanger as defined in claim 2, further comprising a recess in said member, said aperture being located in said base portion and in said recess.

6. A picture hanger as defined in claim 5, wherein said recess is a trough extending across said member.

7. A picture hanger as defined in claim 6, wherein said trough extends parallel to said edges.

8. A picture hanger as defined in claim 5, further comprising a support surface within said recess opposite said base portion, said support surface surrounding said aperture and being inclined inwardly at an angle of about 45° with respect to said wall when said member is biased against said wall.

9. A picture hanger as defined in claim 8, wherein said fastener is a double-headed nail.

10. A picture hanger as defined in claim 1, wherein said wire is rigid.

* * * * *